US010273920B2

(12) United States Patent
Lucas

(10) Patent No.: US 10,273,920 B2
(45) Date of Patent: Apr. 30, 2019

(54) SINGLE PISTON PUMP WITH REDUCED PISTON SIDE LOADS

(71) Applicant: Stanadyne LLC, Windsor, CT (US)

(72) Inventor: Robert G. Lucas, Ellington, CT (US)

(73) Assignee: Stanadyne LLC, Windsor, CT (US)

( * ) Notice: Subject to any disclaimer, the term of this patent is extended or adjusted under 35 U.S.C. 154(b) by 513 days.

(21) Appl. No.: 14/865,178

(22) Filed: Sep. 25, 2015

(65) Prior Publication Data

US 2017/0089311 A1 Mar. 30, 2017

(51) Int. Cl.

| | |
|---|---|
| ***F02M 59/02*** | (2006.01) |
| ***F02M 59/44*** | (2006.01) |
| ***F02M 59/10*** | (2006.01) |
| ***F04B 9/04*** | (2006.01) |
| ***F04B 53/14*** | (2006.01) |
| ***F04B 53/16*** | (2006.01) |
| ***F04B 1/04*** | (2006.01) |

(52) U.S. Cl.

CPC ..... *F02M 59/44* (2013.01); *F02M 59/025* (2013.01); *F02M 59/102* (2013.01); *F04B 1/0408* (2013.01); *F04B 1/0417* (2013.01); *F04B 1/0426* (2013.01); *F04B 9/042* (2013.01); *F04B 53/14* (2013.01); *F04B 53/16* (2013.01)

(58) Field of Classification Search

CPC .. F02M 59/102; F02M 2200/03; F02M 59/44; F02M 59/442; F02M 59/025; F04B 1/0426; F04B 53/16; F04B 1/0408; F04B 53/14; F04B 1/0417; F04B 9/042

See application file for complete search history.

(56) References Cited

U.S. PATENT DOCUMENTS

2011/0303195 A1* 12/2011 Lucas ..... F02M 59/102 123/495
2013/0084198 A1* 4/2013 Wood ..... F02M 59/102 417/374

* cited by examiner

*Primary Examiner* — Abiy Teka
(74) *Attorney, Agent, or Firm* — Alix, Yale & Ristas, LLP

(57) ABSTRACT

In a tappet-driven single piston pump, piston side loads caused by return spring out-of-squareness are eliminated by effectively piloting the piston return spring, preferably the associated spring seat, by the tappet, thereby allowing the tappet to bear the spring side load. The piston engages and is returned by the spring seat, but radial clearance between the piston and spring seat is greater than radial clearance between the spring seat and tappet, thus eliminating side loading imparted to the piston. The spring seat can be considered a piston retainer, in which the piston is not closely attached to the retainer but instead exhibits a pre-defined radial clearance greater than the piloting clearance between the retainer and the tappet.

15 Claims, 6 Drawing Sheets

SINGLE PISTON PUMP WITH REDUCED PISTON SIDE LOADS

BACKGROUND

Single piston, cam driven high pressure pumps have become a common solution for generating high pressure fuel in today's common rail, direct injection, gasoline engines. These pumps are typically driven via a tappet and cam with multiple lobes. In order to keep the tappet in contact with the cam and pump piston in contact with the tappet at high speeds, a coil spring is positioned between the pump body and a spring seat affixed to the pump piston. This execution has proven robust in regions of the world with well controlled fuel quality. In regions of the world with poor fuel quality, pump piston seizures have been a problem due to fluid film breakdown and poor lubricating qualities of those fuels. It is advantageous for these applications to reduce pump piston side loads in order to minimize the fluid film breakdown. One significant source of these side loads is the out-of-squareness of the piston/tappet return spring positioned between the pump body and plunger spring seats. When both ends are constrained by each spring seat to radially align the spring, the spring must be deflected to do so, and in the installed state a significant side load will be imparted to the pump piston.

SUMMARY

The primary purpose of this invention is to eliminate pump piston side loads caused by spring out-of-squareness, making the pump resistant to seizures when run on poor quality fuels.

The invention accomplishes this by effectively piloting the piston return spring, preferably the associated spring seat, by the tappet, thereby allowing the tappet to bear the spring side load. The piston engages and is returned by the spring seat, but radial clearance between the piston and spring seat is greater than radial clearance between the spring seat and tappet, thus eliminating side loading imparted to the piston.

The spring seat can be considered a piston retainer that features a novel relationship between the piston and the piston retainer, in that the piston is not closely attached to the retainer but instead exhibits a predefined radial clearance greater than the piloting clearance between the retainer and the tappet.

BRIEF DESCRIPTION OF THE DRAWING

The invention will be disclosed in greater detail with reference to the accompanying drawing, in which.

DETAILED DESCRIPTION

Figure 1:
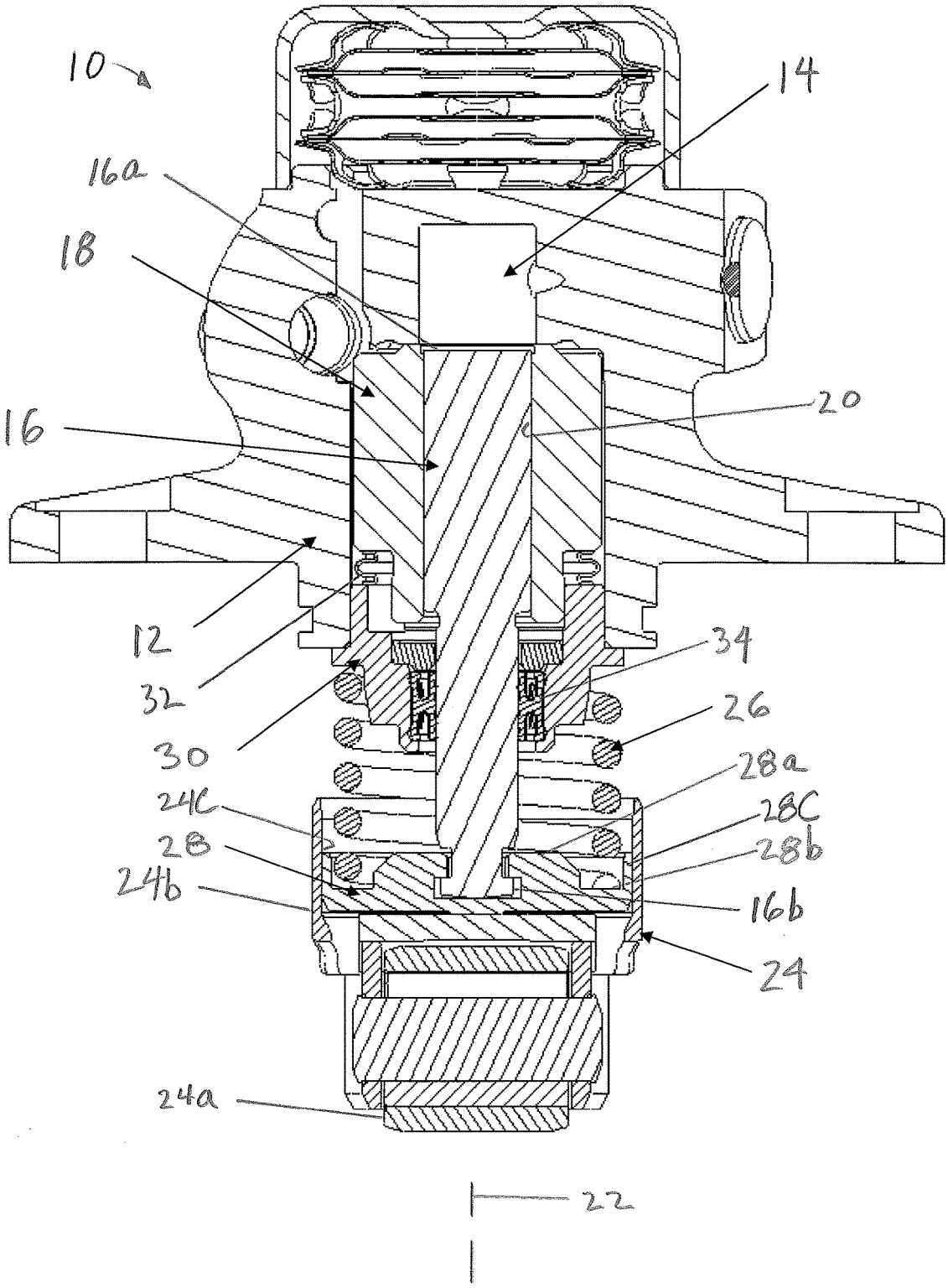
FIG. 1 is a longitudinal section view of a pump that incorporates one embodiment of the present invention.
Figure 2:
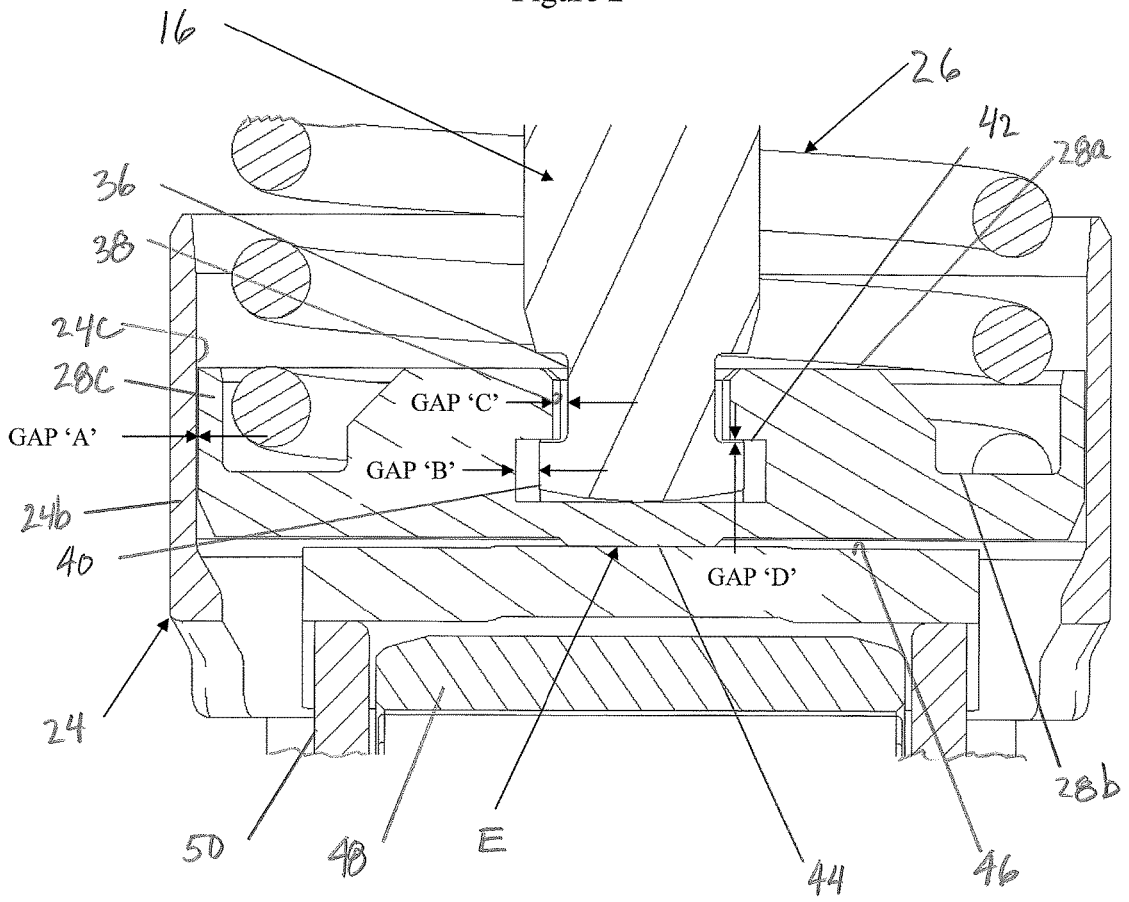
FIG. 2 is a detailed view of a portion of FIG. 1, showing the region of the pump where the tappet drives the pumping piston.

FIGS. 1 and 2 show a cam-driven high pressure single piston fuel pump 10 having a pump housing 12, a pumping chamber 14 within the pump housing, a piston 16 with one end 16*a* in the pumping chamber and another end 16*b* outside the pump housing. A piston sleeve 18 is mounted in the pump housing and has a bore 20 in which the piston reciprocates with specified clearance along a pumping axis 22 between a retracting motion during which fuel is delivered to the pumping chamber and a pumping motion during which the piston pressurizes fuel in the pumping chamber. A tappet 24 is coaxially aligned with the piston 16, having one end 24*a* adapted to be reciprocally driven by a rotating cam and another end 24*b* operatively associated with the other end 16*b* of the piston for reciprocating the piston. A coil return spring 26 is seated between the housing 12 and a generally disc-like tappet spring and piston retainer 28 (hereinafter, "piston retainer") with the return spring and piston retainer coaxially aligned with the piston and operatively associated at 28*b* with the piston, for biasing the other end of the piston away from the pumping chamber via the engagement of the piston end 16*b* with the portion 28*b* of the piston retainer 28. Preferably, the end of the spring 26 closer to the housing 12 seats in the outer portion of a sleeve retainer 30, with the inner end of the sleeve retainer acting through a load ring 32 to urge the upper end of the sleeve 18 into sealing engagement around the periphery of the pumping chamber at the upper end of bore 20. The piston 16 is also fluidly sealed at 34, within the sleeve retainer 30.

The tappet 24 is forced upward by rotation of an engine camshaft. The tappet forces the piston 16, retainer 28, and piston 16 upward to compress fluid in the pumping chamber 14. The high pressure fluid from the pumping chamber is then forced through a check valve and via connections into a common rail.

In a key aspect of the present disclosure, the tappet 24 and the piston retainer 28 have radially overlapping concentric walls 24*c*, 28*c* with a radial gap A that accommodates side loads on the spring 26. In order to prevent side load imparted by spring out-of-squareness within normal tolerances against the piston 16 the piston retainer 28 is guided on its OD within the ID of tappet 24. This is guaranteed by assuring that gap A is always smaller than gaps B and C. The piston retainer 28 is positioned axially against the tappet 24 at interface E and is preloaded by spring 26. Because gap A is smaller than gaps B and C, the tappet 24 bears all side loads imparted by the spring 26.

In the illustrated embodiment, the other end 16*b* of the piston is operatively associated with the retainer at 28*a* by a profiled tip of the piston, such a neck or shank 36, that is captured in a recess of the retainer, such as 38, and head or flange portion 40 captured by shoulder 42, with a radial gaps B and C that are each greater than the radial gap A between the retainer and the tappet. An axial gap D is also provided as a lash feature at the shoulder 42. This lash prevents the load of the spring 26 from bearing directly against the piston 16 in the axial direction. In this embodiment, the central portion of the axial end 44 of the piston retainer 28 protrudes and bears on the surface 46 of the tappet drive element 48. In essence, the profiled tip 16*b* of the piston has a smaller diameter shank portion passing through a central opening defining a recess of the piston retainer and a larger diameter flange portion captured by a shoulder within the retainer. To facilitate assembly, the piston retainer has a slot from the circumference to the whereby the piston end 16*b* can be slid radially into position in the recess.

Preferably, Gap A should be at least 2 microns, Gaps B and C should be at least 10 microns, and gap D should be at least 2 microns. Generally, the radial Gap C should be at least five times the radial Gap A.

It should be appreciated that the present invention can be employed with a wide variety of tappet and piston connections. In FIGS. 1 and 2, the tappet is a so-called "bucket" tappet wherein the main tappet shaft 50 has a drive element 48 and together with a substantially cylindrical collar 24*b* engaging and extending axially from the main shaft, define a generally cup or bucket shaped collar with cylindrical wall portion 24*c* concentrically overlapping the outer circumference of 28*c* of the piston retainer 28, with nominal gap A.

Figure 3:
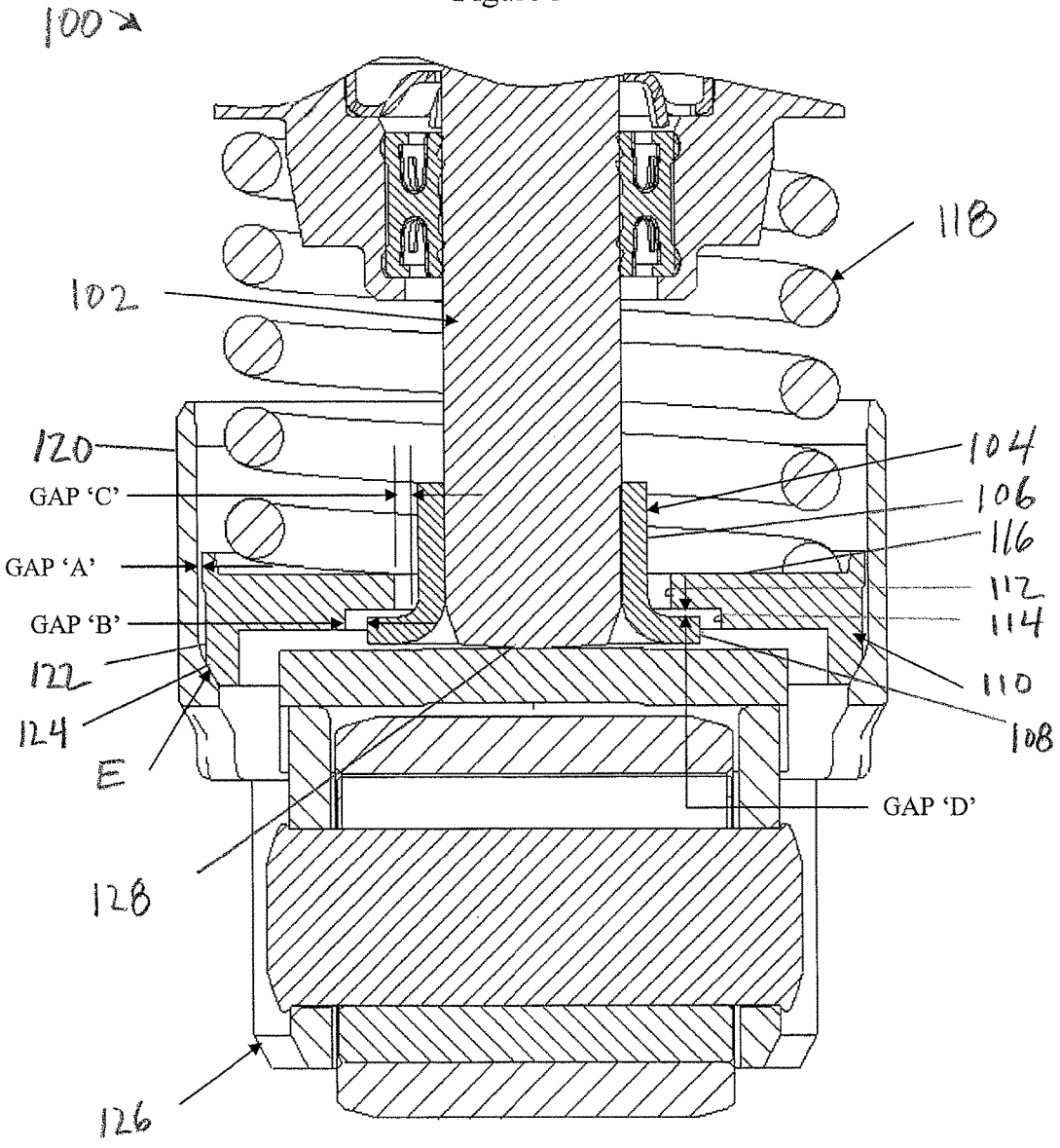
FIG. 3 is a detailed view similar to FIG. 2, showing a second embodiment of the invention.

FIG. 3 depicts an alternate embodiment 100, which also eliminates spring induced side loads on piston 102. The piston retainer 104 has a radially inner retainer element. 106 that is affixed to the piston and flares 108 radially outwardly. A radially outer retainer element 110 has stepped inner portion with edges 112, 114 that are radially spaced from the cylindrical portion of the inner element and flange, respectively. The outer element is also axially spaced above the flange 108 of the inner retainer element, providing axial lash D and radial clearances B and C. The outer element 110 includes a radially outer surface 116 that provides a seat for the spring 118. The tappet extension 120 is a cylindrical collar and the outer element 110 pilots within the collar 120 with a radial clearance A less than the radial clearances between the outer retainer and inner retainer.

In this execution, the outer retainer 110 has a depending rim that bears on a shoulder 124 at the inside base of the collar. The piston retainer element 110 is guided on its OD within the ID of the tappet collar 120, but bears axially against the tappet along a peripheral edge at interface E. Inner retainer 106 is fastened to the piston via a press-fit. Gaps A, B, C, and D correspond to and have the same function as the similarly labelled gaps in FIGS. 1-2. In this execution the axial pumping loads are transmitted directly from the tappet 126 to the piston end surface 128.

Figure 4:
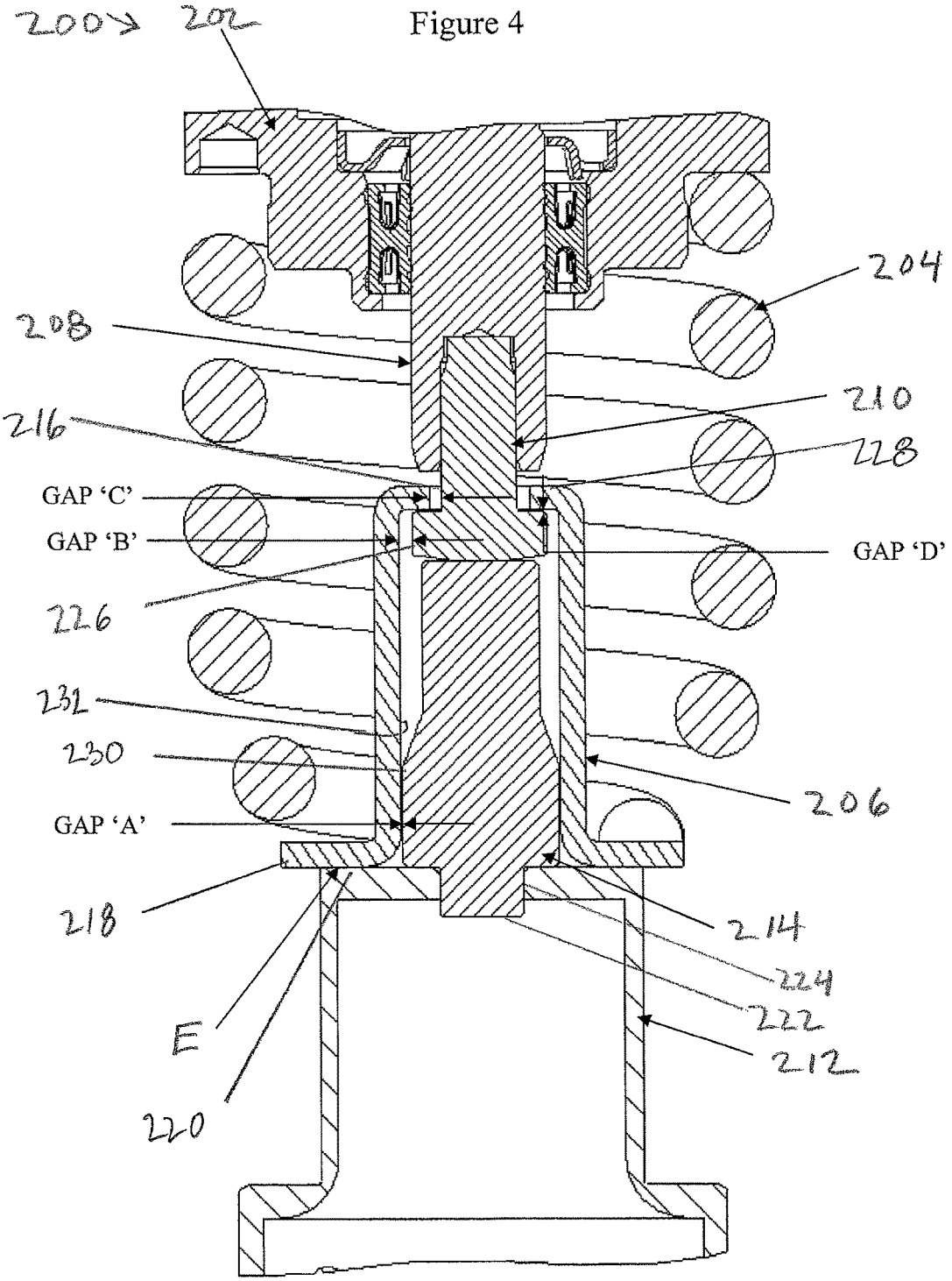
FIG. 4 is a detailed view similar to FIG. 2, showing a third embodiment of the invention.

FIG. 4 depicts another embodiment 200, which also eliminates spring induced piston side loads. Spring retainer 202 is at the housing, seating one end of spring 204, with the other end seated in a different kind of piston and tappet spring retainer 206. The piston 208 has a body portion and an insert or extension portion 210, with the extension portion coaxially secured to the body portion and defining the profiled tip of the piston. The tappet 212 has a body portion and an extension or insert portion 214, in the form of a plug that is surrounded by the retainer and thus defines the wall that pilots the retainer. The piston extension enters the tappet extension through a hole 216 at the top.

The piston retainer 206 has an outwardly flared bottom 218 that bears on drive surface 220 of the tappet 212. The tappet extension can be connected to the drive surface 220 with a reduced diameter boss or the like 222 passing through a hole 224 in that surface.

The piston profile includes a narrowed shank and enlarged flange 226, which cooperate with the inwardly turned flange 228 at the top of the piston retainer. In this execution the tappet is inside the piston retainer and provides OD 230 to the ID 232 of the piston retainer with radial gap A In this embodiment interface E is shown as a surface normal to the pump axis. Gaps B, C, and D are functional equivalents to corresponding gaps previously described.

It should be appreciated that the piston extension 210 and tappet extension 214 are shown as inserts, but these could be integral with the main bodies 208, 212 to provide equivalent functionality.

Figure 5:
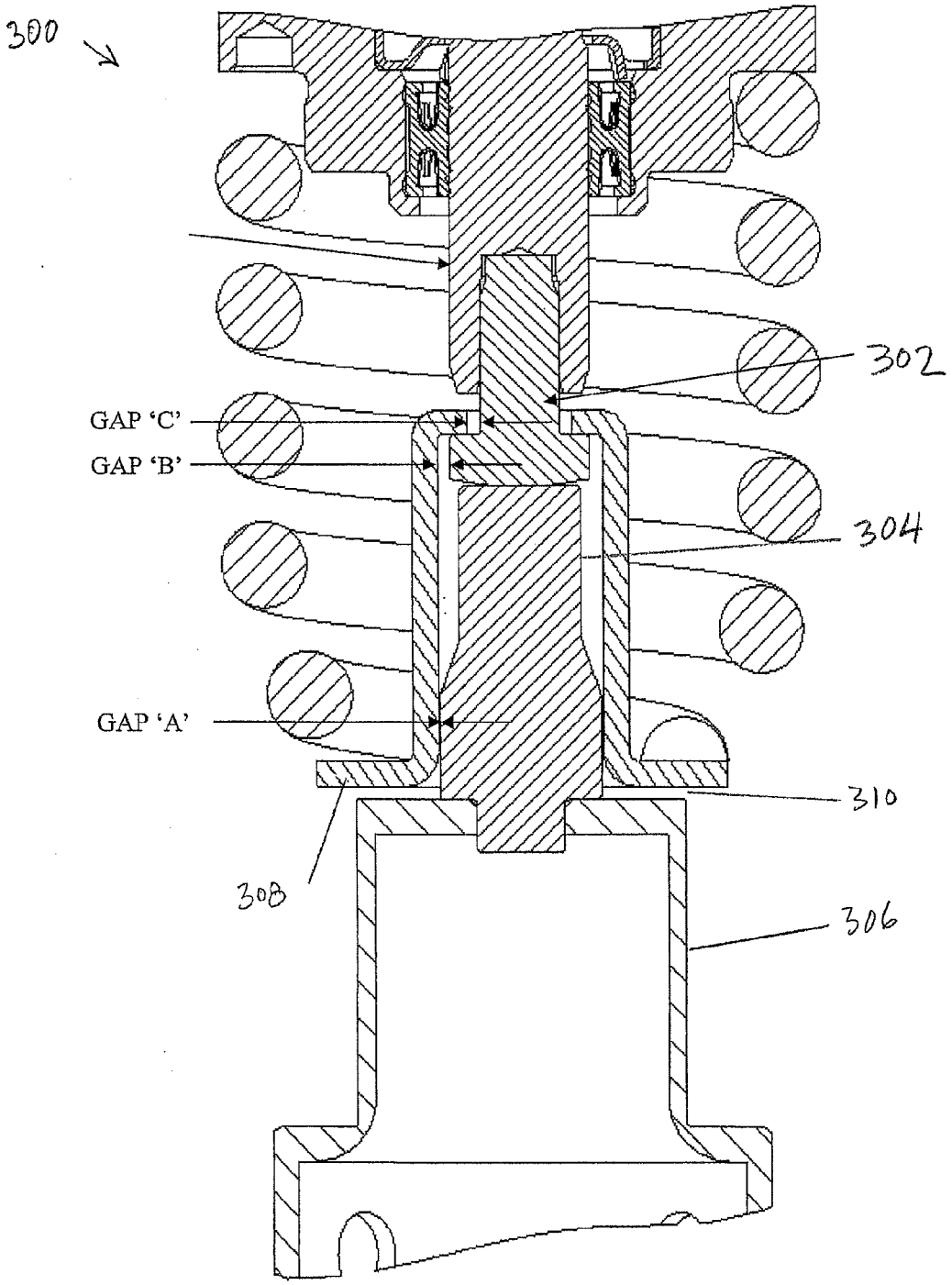
FIG. 5 is a detailed view similar to FIG. 2, showing a fourth embodiment of the invention.
Figure 6:
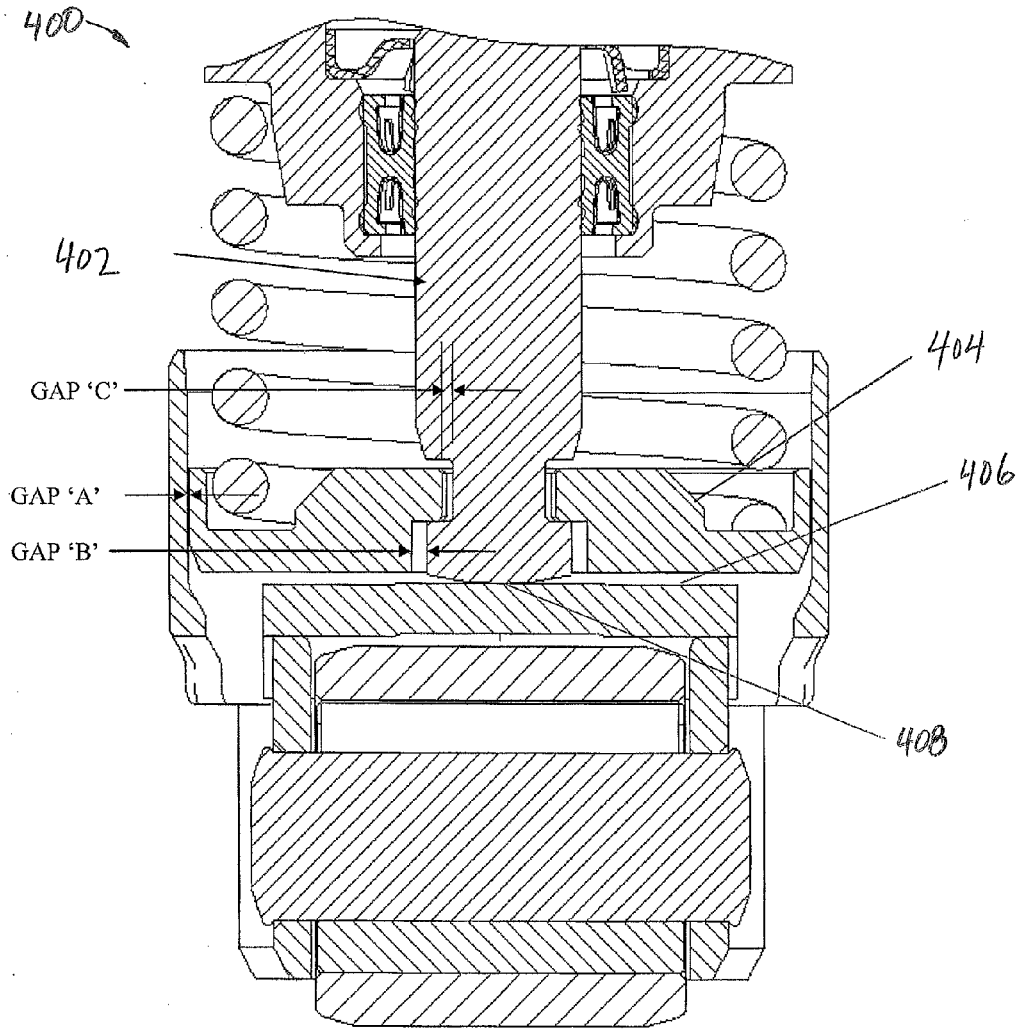
FIG. 6 is a detailed view similar to FIG. 2, showing a fifth embodiment of the invention.

FIG. 5 depicts an another embodiment 300 similar to FIG. 4 in which Gap D has been eliminated, thus eliminating all axial lash of the piston and piston insert 302 relative to tappet and tappet insert 304. Gaps A, B, and C maintain the same function as previously described. The load bearing interface between the tappet body 306 and the bottom 308 of the piston reatiner has also been eliminated (at 310). FIG. 6 depicts an alternative embodiment 400 to FIGS. 1 and 2 in which Gap D has been eliminated, thus eliminating all axial lash of the piston 402 relative to the piston retainer 404. and tappet 406. Gaps A, B, and C maintain the same function as previously described. The load bearing interface between the tappet 406 and piston retainer 404 has also been eliminated. The tappet 406 bears directly against the lower tip 408 of the piston.

The invention claimed is:

1. A cam-driven high pressure single piston fuel pump having a pump housing, a pumping chamber within the pump housing, a piston with a first end in the pumping chamber and a second end outside the pump housing, a bore within the housing in which the piston reciprocates between a retracting motion during which fuel is delivered to the pumping chamber and a pumping motion during which the piston pressurizes fuel in the pumping chamber, a tappet having one end adapted to be reciprocally driven by a rotating cam and another end operatively connected to the second end of the piston for reciprocating the piston; a disc-shaped retainer with upper and lower sides, said retainer trapping the second end of the piston at the upper side of the retainer with an axial lash and with a first radial clearance between the piston second end and the retainer, the tappet bears directly against the lower side of the retainer; a return spring seated on said retainer for biasing the other end of the tappet away from the pumping chamber; a cylindrical collar tappet extension on said other end of the tappet surrounding the retainer with a second radial clearance between the retainer and the tappet extension that is smaller than the first radial clearance, and the retainer pilots within the tappet extension.

2. The fuel pump of claim 1, wherein said bore within the housing is defined by a piston sleeve situated entirely within the housing and another retainer is interposed between the piston sleeve and the spring such that the spring is captured between the retainers.

3. The fuel pump of claim 1, wherein the first radial clearance between the piston second end and the retainer is at least five times greater than the second radial clearance between the retainer and the tappet extension.

4. The fuel pump of claim 3, wherein the first radial clearance between the piston second end and the retainer is at least 10 microns.

5. The fuel pump of claim 1, wherein the first radial clearance between the piston second end and the retainer is at least 10 microns.

6. A cam-driven high pressure single piston fuel pump having a pump housing, a pumping chamber within the pump housing, a piston with a first end in the pumping chamber and a second end outside the pump housing, a bore within the housing in which the piston reciprocates between a retracting motion during which fuel is delivered to the pumping chamber and a pumping motion during which the piston pressurizes fuel in the pumping chamber, a tappet having one end adapted to be reciprocally driven by a rotating cam and another end operatively connected to the second end of the piston for reciprocating the piston; a retainer trapping the second end of the piston with a first radial clearance between the piston second end and the retainer; a return spring seated on said retainer for biasing the other end of the tappet away from the pumping chamber; an extension on said other end of the tappet piloting the retainer with a second radial clearance between the retainer and the tappet extension that is smaller than the first radial clearance, wherein the tappet bears directly against the piston, said piston includes a radially inner retainer element affixed to the piston, a radially outer retainer element has an inner portion that radially overlaps the inner retainer element with axial lash and radial clearance between the outer retainer and inner retainer, and an outer portion that provides a seat for said spring, the tappet extension is a cylindrical collar and said outer retainer pilots within the collar with a radial clearance less than the radial clearance between the outer retainer and inner retainer.

7. The fuel pump of claim 6, wherein said bore is defined by a piston sleeve situated entirely within the housing and another retainer is interposed between the piston sleeve and spring such that the spring is captured between the retainers.

8. The fuel pump of claim 6, wherein the first radial clearance between the piston and the retainer is at least 10 microns.

9. The fuel pump of claim 6, wherein the first radial clearance between the piston second end and the retainer is at least five times greater than the second radial clearance between the retainer and the tappet extension.

10. The fuel pump of claim 9, wherein the first radial clearance between the piston second end and the retainer is at least 10 microns.

11. A cam-driven high pressure single piston fuel pump having a pump housing, a pumping chamber within the pump housing, a piston with a first end in the pumping chamber and a second end outside the pump housing, a bore within the housing in which the piston reciprocates between a retracting motion during which fuel is delivered to the pumping chamber and a pumping motion during which the piston pressurizes fuel in the pumping chamber, a tappet having one end adapted to be reciprocally driven by a rotating cam and another end operatively connected to the second end of the piston for reciprocating the piston; a retainer trapping the second end of the piston with a first radial clearance between the piston second end and the retainer; a return spring seated on said retainer for biasing the other end of the tappet away from the pumping chamber; an extension on said other end of the tappet piloting the retainer with a second radial clearance between the retainer and the tappet extension that is smaller than the first radial clearance, wherein the retainer bears against the piston and is slidable radially about the piston, the tappet extension is a cylindrical collar, and said retainer pilots within the tappet extension.

12. The fuel pump of claim 11, wherein said bore within the housing is defined by a piston sleeve situated entirely within the housing and another retainer is interposed between the piston sleeve and spring such that the spring is captured between the retainers.

13. The fuel pump of claim 11, wherein the first radial clearance between the piston second end and the retainer is at least 10 microns.

14. The fuel pump of claim 11, wherein the first radial clearance between the piston second end and the retainer is at least five times greater than the second radial clearance between the retainer and the tappet extension.

15. The fuel pump of claim 14, wherein the first radial clearance is at least 10 microns.

* * * * *